US011378370B2

(12) United States Patent
Young et al.

(10) Patent No.: US 11,378,370 B2
(45) Date of Patent: Jul. 5, 2022

(54) CONTAINER FOR FIREARM CARTRIDGES

(71) Applicants: Nicholas E. Young, Murray, UT (US); Kyle K. Hill, Farmington, UT (US)

(72) Inventors: Nicholas E. Young, Murray, UT (US); Kyle K. Hill, Farmington, UT (US)

( * ) Notice: Subject to any disclaimer, the term of this patent is extended or adjusted under 35 U.S.C. 154(b) by 269 days.

(21) Appl. No.: 16/745,216

(22) Filed: Jan. 16, 2020

(65) Prior Publication Data

US 2020/0225013 A1 Jul. 16, 2020

Related U.S. Application Data

(60) Provisional application No. 62/792,901, filed on Jan. 16, 2019.

(51) Int. Cl.
*F42B 39/26* (2006.01)
*F41A 9/84* (2006.01)

(52) U.S. Cl.
CPC ..... *F42B 39/26* (2013.01); *F41A 9/84* (2013.01)

(58) Field of Classification Search
CPC .... F42B 39/26; F41A 9/84; F41A 9/68; F41A 9/61; F41A 9/63; F41A 9/64; F41A 9/65; F41A 9/85
USPC ..... 206/3
See application file for complete search history.

(56) References Cited

U.S. PATENT DOCUMENTS 452,447 A * 5/1891 Bruce ..... F41A 9/84 42/88
869,310 A * 10/1907 Lemly ..... F42B 39/02 224/239
1,455,803 A * 5/1923 Nofsinger ..... F42B 39/02 224/239
1,894,873 A * 1/1933 Johnson ..... B65D 5/2066 229/125.39
2,137,680 A * 11/1938 Vogel ..... F42B 39/002 221/303
2,305,198 A * 12/1942 Shonblom ..... B65D 5/38 206/3
2,751,964 A * 6/1956 Reynolds ..... B31F 1/2822 156/205
3,163,286 A * 12/1964 Covington, Jr. ..... F42B 39/02 206/3
3,424,298 A * 1/1969 Snow ..... F42B 39/26 206/3
3,525,425 A * 8/1970 Hochrieser ..... F42B 39/26 206/3
3,578,152 A * 5/1971 Hartley ..... F42B 39/02 206/3
3,756,387 A * 9/1973 Chaney ..... F42B 39/02 206/3
3,833,165 A * 9/1974 Hoiles ..... B65D 5/28 229/145
3,923,152 A * 12/1975 Minneman ..... F42B 39/02 206/3
4,288,197 A * 9/1981 Gurolnick ..... F42B 39/02 206/3
4,757,894 A * 7/1988 Schreckenstein ..... F42B 39/02 206/1.5

(Continued)

*Primary Examiner* — Ernesto A Grano

(57) ABSTRACT

A cartridge container for firearms is provided that includes a plurality of brackets coupled to an outer cover in such a way that the brackets may be readily independently removed from the outer cover. The brackets are configured to then be used to rapidly load cartridges stored in the brackets into a magazine.

14 Claims, 6 Drawing Sheets

(56) References Cited

U.S. PATENT DOCUMENTS 4,773,541 A * 9/1988 Riddell ..... B65D 75/68 229/235
4,815,609 A * 3/1989 Kiedaisch ..... B65D 5/5405 229/235
4,941,624 A * 7/1990 Schuster ..... B65D 71/36 229/117.13
5,450,947 A * 9/1995 Sgueglia, Sr. ..... B65D 85/20 206/3
5,676,241 A * 10/1997 Degoix ..... F42B 39/26 206/3
6,779,654 B1 * 8/2004 Marquis ..... B65D 43/12 206/223
6,913,189 B2 * 7/2005 Oliff ..... B65D 5/5495 229/120.011
7,395,922 B1 * 7/2008 Sinha ..... F42B 39/26 206/3
8,484,874 B2 * 7/2013 Kim ..... F41A 9/66 42/49.01
9,709,352 B1 * 7/2017 Hess ..... F41A 9/84
9,738,433 B2 * 8/2017 Hogg ..... H01M 50/20
10,336,479 B2 * 7/2019 Deutschle ..... B65D 11/10
10,435,218 B1 * 10/2019 Little ..... F42B 39/22
10,753,718 B1 * 8/2020 Compton ..... B65D 5/2033
10,782,111 B1 * 9/2020 Boyajian ..... F42B 39/08
2006/0289334 A1 * 12/2006 Lechelle ..... B65D 5/5038 206/736
2009/0223103 A1 * 9/2009 Young ..... F41A 9/70 42/50
2013/0118922 A1 * 5/2013 McClaughry ..... B65B 5/08 206/3
2015/0096907 A1 * 4/2015 Connolly ..... F42B 39/26 206/3
2019/0041181 A1 * 2/2019 Little ..... F42B 30/08

* cited by examiner

CONTAINER FOR FIREARM CARTRIDGES

CROSS-REFERENCE TO RELATED APPLICATION

This application is a non-provisional application of U.S. Provisional 62/792,901 entitled "CONTAINER FOR FIREARM CARTRIDGES" filed Jan. 16, 2019, the disclosure of which is hereby incorporated by reference in its entirety.

BACKGROUND

Some conventional firearm cartridge containers are known that contain cartridges in a manner that protects the cartridges but require operators to remove cartridges from the containers and load them into a magazine one at a time. Other firearm cartridge containers, referred to as stripper clips, contain several cartridges in a clip or retainer that allows for more rapid loading into a magazine, but do not protect the projectiles from unintended damage from contact with other stripper clips.

SUMMARY

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

A container for firearm cartridges includes a first bracket having a first side portion, a second side portion, an outer portion, and a cartridge support portion. A second bracket includes a first side portion, a second side portion, an outer portion and a cartridge support portion. An outer cover includes a top portion, a bottom portion, a first side portion, a second side portion, a first end, and a second end. The first bracket is coupled to the outer cover and the second bracket is coupled to the outer cover such that the cartridge support portion of the first bracket faces the cartridge support portion of the second bracket. The bottom portion has at least one bottom tear line formed therein to facilitate removal of the bottom portion of the outer container to expose the first bracket. The top portion has at least one top tear line formed therein to facilitate removal of the top portion of the outer container to expose the second bracket. The first bracket and the second bracket are coupled to the outer cover in such a way that removing the bottom side and the top side does not decouple the first bracket or the second bracket from the outer cover.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

As will be discussed in more detail hereinafter, the outer cover is coupled with the first and second brackets in such a way that the first and second brackets may be rapidly pulled from the rest of the cartridge container assembly, and the cartridges may then be quickly loaded from the then-freed first bracket or second bracket into a magazine or otherwise, taken from the first bracket or second bracket as applicable.

Figure 1A:
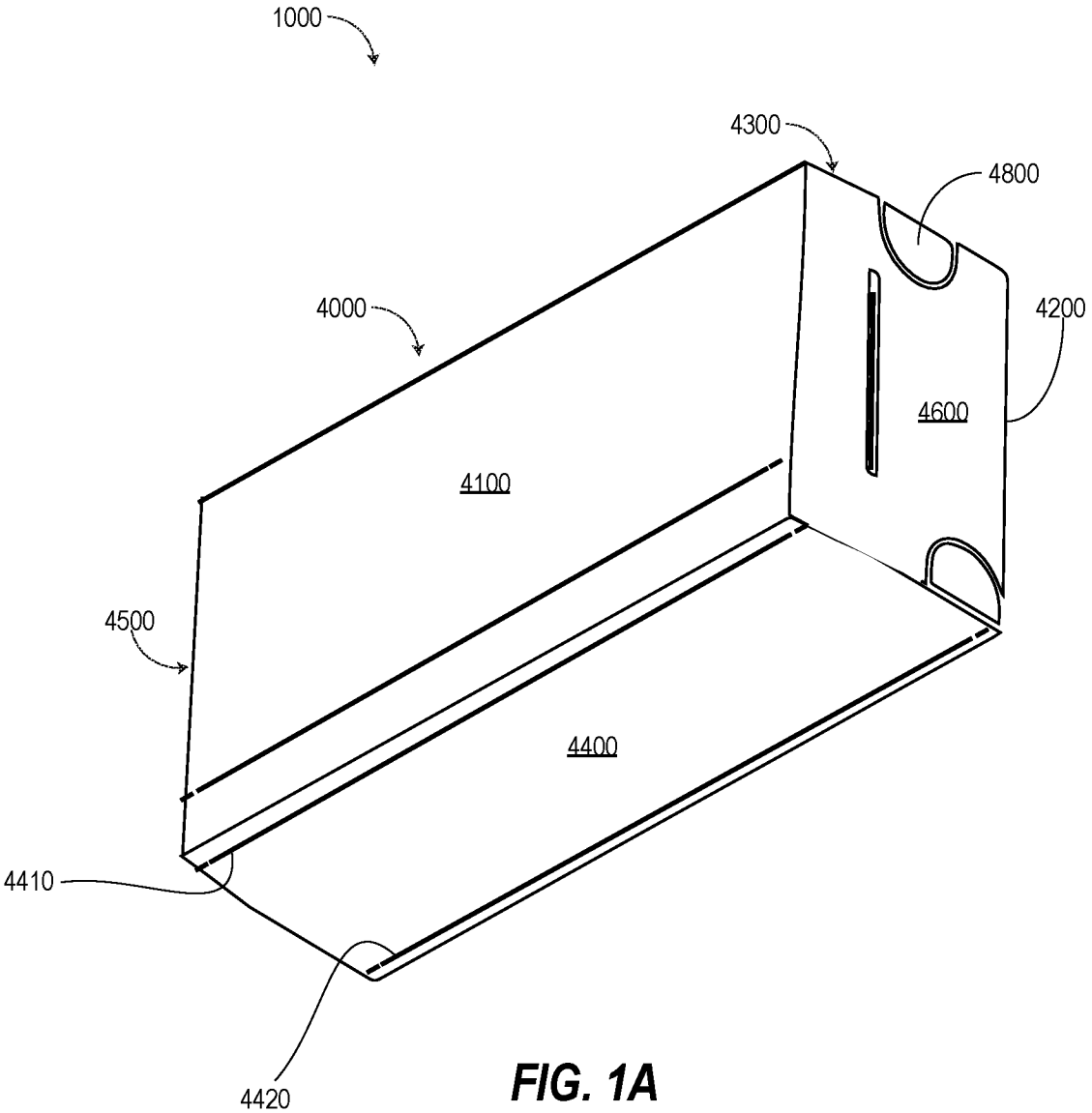
FIG. 1A illustrates a perspective view of a firearm cartridge container assembly.
Figure 1B:
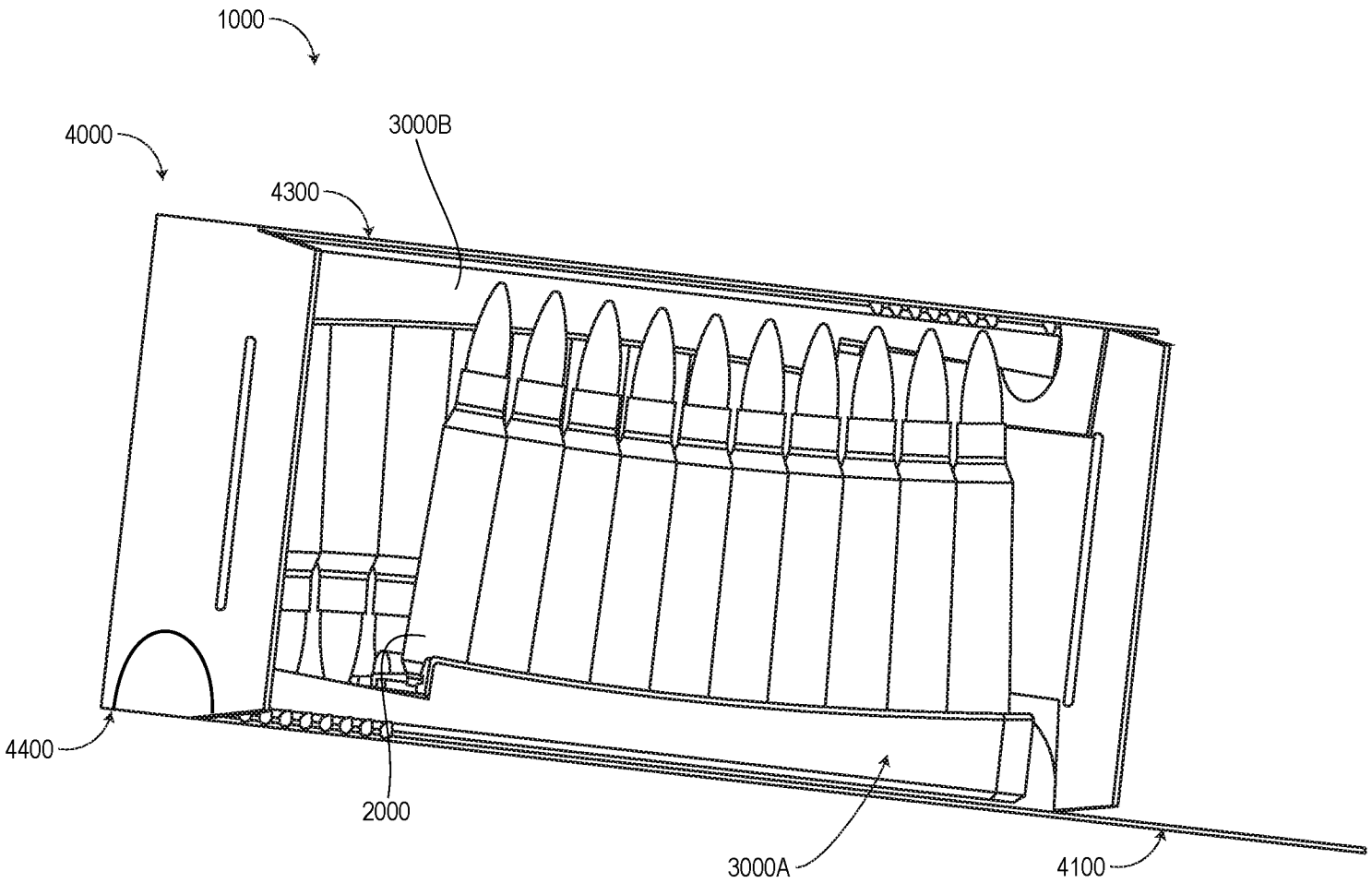
FIG. 1B illustrates the firearm cartridge container assembly of FIG. 1A in which part of the outer cover of the container is open to show the alignment and position of a plurality of brackets and cartridges.

As shown in FIG. 1A, cartridge container assembly 1000 generally includes an outer portion or outer cover 4000. As shown in FIG. 1B, the cartridge container assembly 1000 is configured to receive and engage a plurality of cartridges 2000. In particular, the cartridge container assembly 1000 further includes a plurality of brackets including first bracket 3000A and second bracket 3000B configured to engage and retain the cartridges 2000 and an outer cover 4000 configured to engage and selectively retain the first and second brackets 3000A, 3000B.

Figure 2:
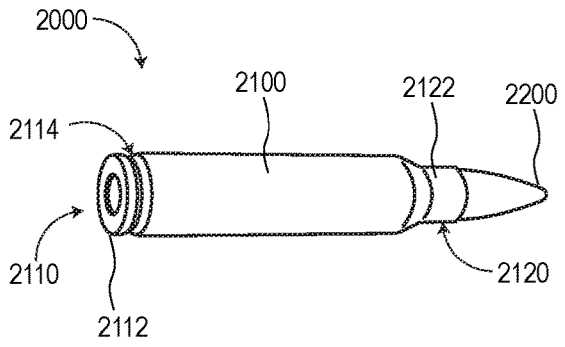
FIG. 2 is a side view of a firearm cartridge.

Referring now briefly to FIG. 2, each cartridge 2000 includes a case 2100 containing a powder charge and a primer as well as a projectile 2200 secured to the case 2100, as is well known in the art. The case 2100 includes a proximal end 2110 (referred to the end nearest an operator when the cartridge is in battery in a firearm) and a distal end 2120. The proximal end 2110 includes a rim portion 2112 and a groove 2114 defined in the case 2100 distally of the rim portion 2112. The distal end 2120 has a neck 2122 configured to engage the projectile 2200.

Referring now again simultaneously to FIG. 2 and FIGS. 3A and 3B, the first bracket 3000A is configured to receive and engage the rim 2112 of each case 2100. It will be appreciated that the second bracket 3000B, shown in FIG. 1B and the rest of the drawings, is substantially similar to the first bracket 3000A, shown and described in FIG. 3A. The first and second brackets 3000A, 3000B are described separately to facilitate discussion of the assembled cartridge container assembly 1000.

Figure 3A:
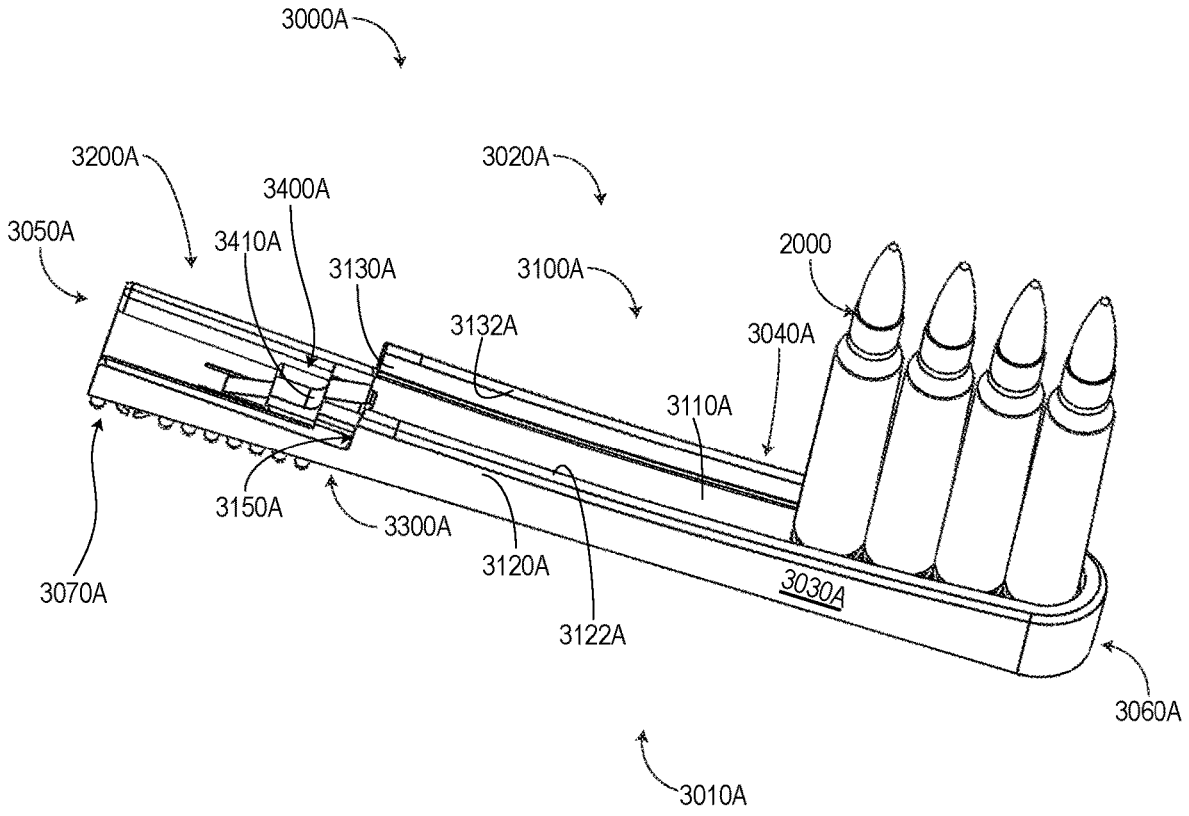
FIG. 3A is a perspective view of a bracket according to one example.

With continuing reference to FIG. 3A, the first bracket 3000A includes an outer portion 3010A and a cartridge support portion 3020A, configured to secure and retain cartridges 2000. Opposing lateral sidewalls 3030A, 3040A extend between the outer portion 3010A and the cartridge support portion 3020A. The first bracket 3000A also includes a first end 3050A and second end 3060A.

The cartridge support portion 3020A includes a rim engagement portion 3100A and magazine engagement portion 3200A. The rim engagement portion 3100A is configured to receive a selected number of cartridges and provide support and engagement for the cartridges, while a retention portion 3300A, between the rim engagement portion 3100A and the magazine engagement portion 3200A of the first bracket 3000A, is configured to retain those cartridges 2000 within the casing rim engagement portion after they have been positioned within the rim engagement portion 3100A until such time as the cartridges 2000 are to be removed, such as by loading the cartridges into a magazine. The configuration of the first bracket 3000A will be described first, followed by a description of coupling or placing cartridges in the first bracket 3000A, and thereafter removing the cartridges from the bracket will be discussed.

The rim engagement portion 3100A includes a case support surface 3110A. Opposing lateral bracket supports 3120A, 3130A extend away from the case support surface 3110A. Bracket flanges 3122A, 3132A extend away from the lateral bracket supports 3120A, 3130A. Such a configuration provides a shape for the rim engagement portion 3100A of the first bracket 3000A that allows the first bracket to receive and engage the rim 2112 adjacent the groove 2114 (FIG. 2).

As shown in the FIG. 3A, the cartridge retention portion 3300A is positioned adjacent the rim engagement portion 3100A of the first bracket 3000A. The cartridge retention portion 3300A includes a tab mechanism 3400A. The tab mechanism 3400A includes a tab 3410A that is biased so as to extend away from the case support surface 3110A and thus provide an obstruction to the rim engagement portion 3100A when the tab 3410A is in a default state.

The tab 3410A is configured to be moved to a position generally planar with or below the case support surface 3110A when a force is applied in the appropriate direction to the tab 3410. For example, when the proximal end 2110 of the case 2100 (both seen best in FIG. 2) is moved along the case support surface 3110A, the case 2100 (again both best seen in FIG. 2) may act to displace the tab 3410 as the cartridge 2000 is moved into position within the first bracket 3000A. As illustrated in the FIG. 3A, the lateral bracket supports 3120A, 3130A end near or adjacent the cartridge retention portion 3300 of the bracket 3000 and may form a stepped lip 3150A or edge between the rim engagement portion 3100A and the magazine engagement portion 3200A. As will be discussed in more detail at an appropriate point hereinafter, such a configuration may allow the bracket 3000A to be readily positioned adjacent a magazine to allow cartridges 2000 in the bracket 3000 to be quickly fed into the magazine.

The second bracket 3000B is substantially similar to the first bracket 3000A and is described separately for clarity in describing the orientation and position of the first and second brackets 3000A, 3000B with the rest of the cartridge container assembly 1000. Accordingly, the second bracket 3000B includes an outer portion 3010B and a cartridge support portion 3020B, configured to secure and retain cartridges 2000. Opposing lateral sidewalls 3030B, 3040B extend between the outer portion 3010B and the cartridge support portion 3020B forming a first end 3050B and second end 3060B of the second bracket 3000B.

The cartridge support portion 3020B includes a rim engagement portion 3100B and magazine engagement portion 3200B. The rim engagement portion 3100B is configured to receive a selected number of cartridges and provide support and engagement for the cartridges, while a retention portion 3300B between the rim engagement portion 3100B and the magazine engagement portion 3200B of the second bracket 3000B is configured to retain those cartridges 2000 within the rim engagement portion 3100B after they have been positioned within the rim engagement portion 3100B until such time as the cartridges 2000 are to be removed, such as by loading the cartridges 2000 into a magazine.

The rim engagement portion 3100B includes a case support surface 3110B. Opposing lateral bracket supports 3120B, 3130B extend away from the case support surface 3110B. Bracket flanges 3122B, 3132B extend away from the lateral bracket supports 3120B, 3130B. Such a configuration provides a shape for the rim engagement portion 3100B of the second bracket 3000B that allows the second bracket 3000B to receive and engage the rim 2112 adjacent the groove 2114 (FIG. 2).

Figure 3B:
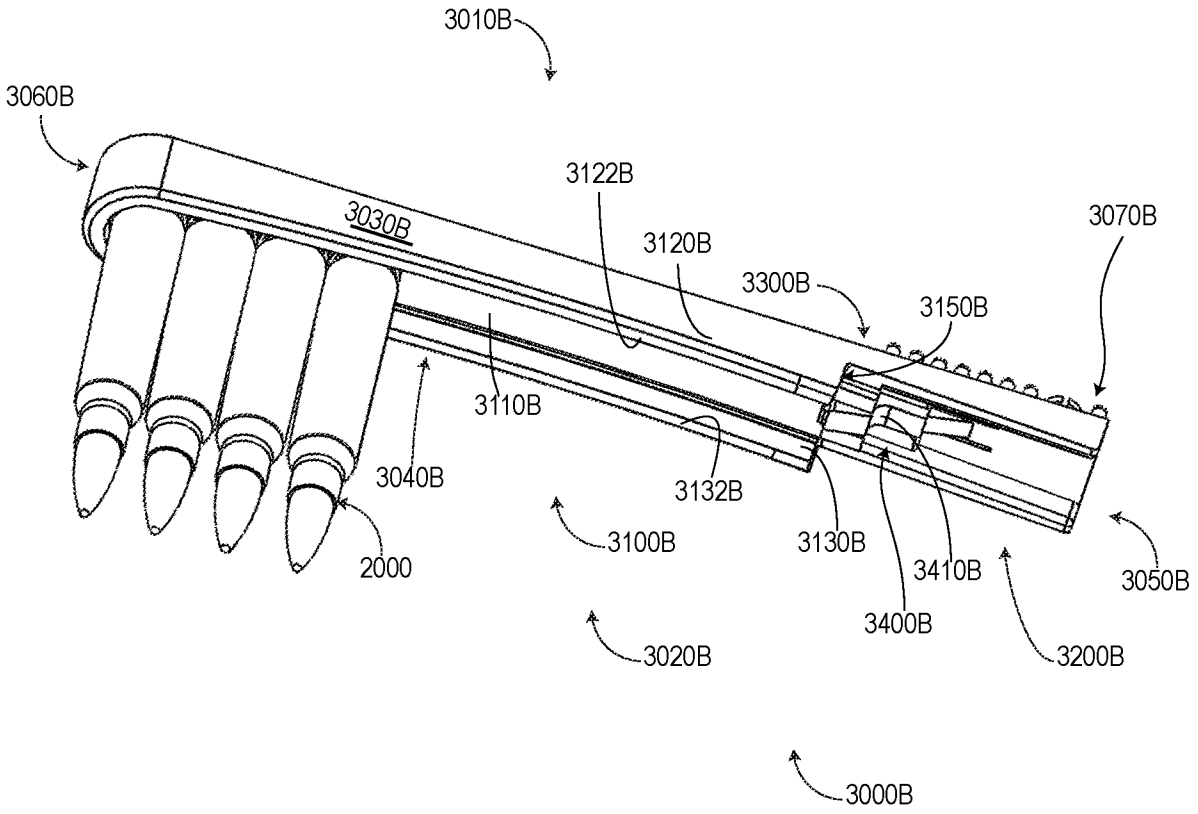
FIG. 3B is a perspective another bracket similar to the bracket shown in FIG. 3A.

As shown in FIG. 3B, the cartridge retention portion 3300B of the second bracket 3000B is positioned adjacent the rim engagement portion 3100B of the first bracket 3000B. The cartridge retention portion 3300B includes a tab mechanism 3400B. The tab mechanism 3400B is positioned adjacent the rim engagement portion 3100B of the second bracket 3000B and adjacent the central bracket channel 3140B in particular. Further, the tab mechanism 3400B includes a tab 3410B that is biased so as to extend away from the case support surface 3110B and thus provide an obstruction to the rim engagement portion 3100B when the tab mechanism 3410B is in a default state.

The tab mechanism 3400B is configured to be moved to a position generally planar with or below the case support surface 3110B when a force is applied in the appropriate direction to the tab 3410B. For example, when the proximal end 2110 of case 2100 (both seen best in FIG. 2) is moved along the case support surface 3110B, the proximal end 2110 of the case 2100 (again both best seen in FIG. 2) may act to displace the tab 3410B as the cartridge 2000 is moved into position within the second bracket 3000B. As illustrated in FIG. 3B, the lateral bracket supports 3120B, 3130B end near or adjacent the cartridge retention portion 3300B of the second bracket 3000B and may form a stepped lip 3150B or edge between the rim engagement portion 3100B and the magazine engagement portion 3200B. As will be discussed in more detail at an appropriate point hereinafter, such a configuration may allow the bracket 3000B to be readily positioned adjacent a magazine to allow cartridges 2000 in the second bracket 3000B to be quickly fed into the magazine.

Referring now to FIG. 1B, as previously introduced, the first and second brackets 3000A, 3000B are part of the cartridge container assembly 1000, which also includes the outer cover 4000. The outer cover 4000 may be a box or other type of outer covering that may be folded, manipulated, or formed so as to provide an enclosure around and be coupled to a plurality of first and second brackets 3000A, 3000B with cartridges 2000 coupled thereto (or to have the first and second brackets 3000A, 3000B coupled thereto as appropriate).

As will be discussed in more detail hereinafter, the outer cover 4000 is coupled with the first and second brackets 3000A, 3000B in such a way that the first and second brackets 3000A, 3000B may be rapidly pulled from the rest of the cartridge container assembly 1000 and the cartridges 2000 may then be quickly loaded from the then-freed first bracket 3000A or second bracket 3000B into a magazine or otherwise taken from the first bracket 3000A or second bracket 3000B as applicable.

Figure 4A:
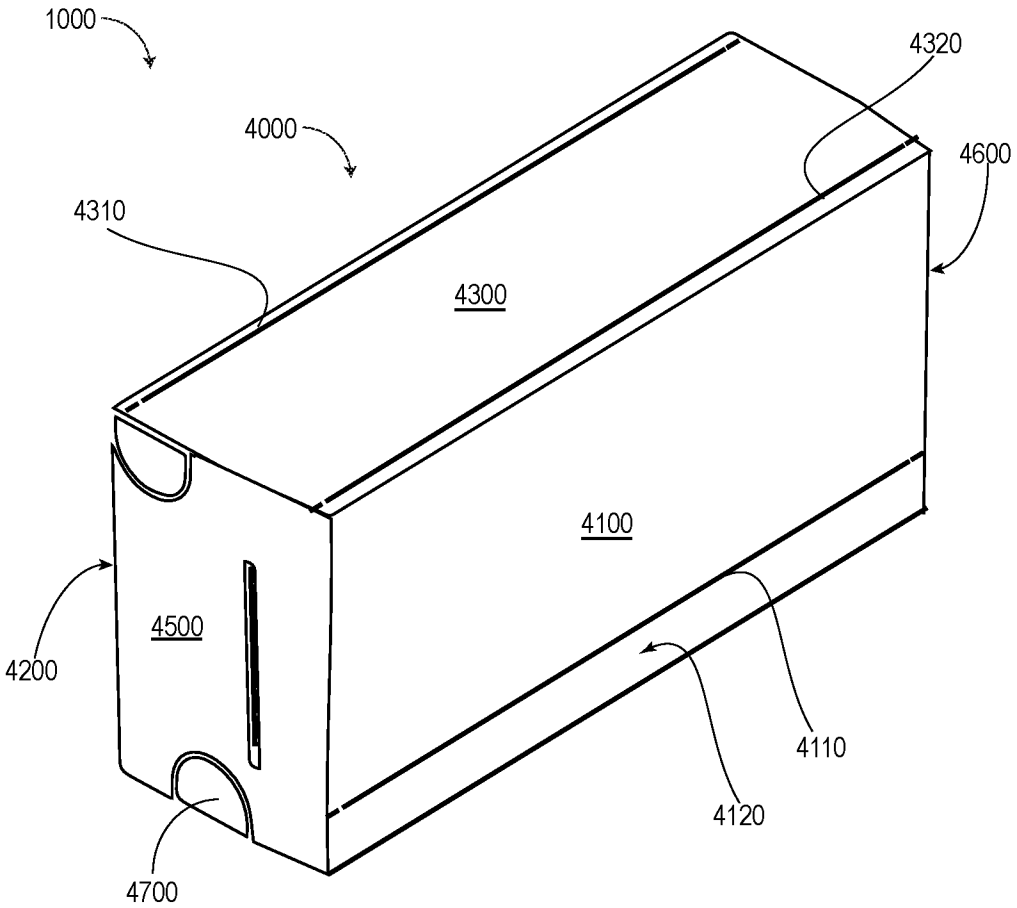
FIG. 4A is a perspective view of a firearm cartridge container assembly.
Figure 4B:
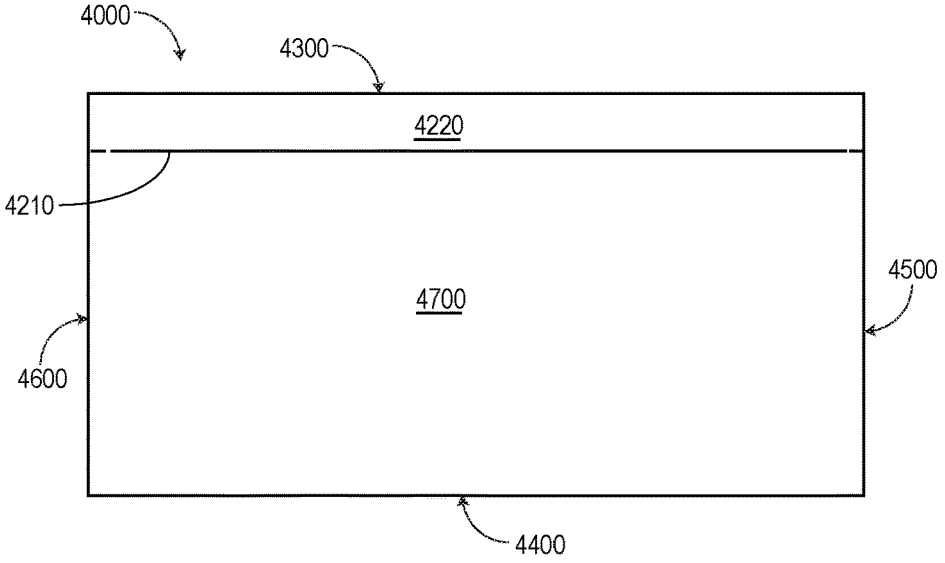
FIG. 4B is a side view of a firearm cartridge container assembly.

Referring simultaneously to FIGS. 1A, 4A, and 4B, the outer cover 4000 may generally include opposing first and second side portions 4100, 4200, opposing top and bottom portions 4300, 4400 (referred to as such for convenience only), and opposing first and second end portion 4500, 4600. When the cartridge container assembly 1000 is assembled, brackets (3000A, 3000B as seen in FIG. 1B) are positioned on opposing sides of the outer cover 4000 in opposing orientations. For example first bracket 3000A may be positioned along the bottom portion 4400 of the outer cover 4000 such that the cartridges 2000 extend toward the top portion 43000 while the second bracket 3000B may be secured or coupled to the top portion 4300 and extends toward the bottom portion 4400. When the cartridge container is assembled, each of the first bracket 3000A, 3000B has a determined number of cartridges retained therein. FIG. 1B is shown with the first side portion 4100 of the outer cover folded or opened away from the rest of the outer cover 4000 to see the interior of the firearm cartridge container assembly 1000.

Referring to FIGS. 1A and 1B, the first lateral sidewall 3030A of the first bracket 3000A is secured to a portion of the first side portion 4100 of the outer cover 4000, while the outer portion 3010A is adjacent the bottom portion 4400 of the outer cover 4000. In at least one example, the bottom portion 4400 of the outer cover 4000 is wider than the outer portion 3010A of the first bracket.

Referring now to FIG. 4B, a first lateral sidewall 3030B of the second bracket 3000B (both best seen in FIG. 1B) is secured to a portion of the second side portion 4200 of the outer cover 4000 while the outer portion 3010B (FIG. 1B) of the second bracket is adjacent the top portion 4300 of the outer cover 4000. Further, the top portion 4300 of the outer cover 4000 is wider than the outer portion 3010B (FIG. 3B) of the second bracket 3000B (also FIG. 3B).

As shown in FIG. 1A, the bottom portion 4400 is scored, perforated, or otherwise selectively weakened so as to provide first and second bottom tear lines 4410, 4420 perforations, or selectively weakened regions along which the outer cover 4000 will tear when subjected to forces applied thereto (the first bottom tear line 4410 being formed in the bottom portion 4400 approximately along the intersection of the bottom portion 4400 and the first side portion 4100 and the second bottom tear line 4420 being approximately along the intersection of the bottom portion 4400 and the second side portion 4200). Selectively weakened regions that comprise the tear lines described herein may also be formed by differences in materials, differences in thickness, perforations, chemical weakening or by any other method that provides a weakened region that will tear in response to a shear force or other pulling forces before the adjacent regions of the outer cover 4000.

Referring to FIGS. 1A and 4A, the bottom portion 4400 of the outer cover 4000 is in communication with a bottom or first punch tab portion 4700 of the first end 4500 of the outer cover 4000. The first punch tab portion 4700 may be selectively weakened, such as by perforations, scoring or other selective weakening methods. Accordingly, the first punch tab portion 4700 of the first end 4500 and the bottom portion 4400 of the outer cover 4000 contain perforations or cutouts that demarcate or otherwise form a selectively removable tear-away portion. In such an example, pushing against the first punch tab 4700 may cause the bottom punch tab 4700 to tear, which may in turn provide a gripping surface or portion.

When used as a gripping portion, the first or bottom punch tab 4700 may then be used to apply a force against the bottom portion 4400 of the outer cover 4000 in a direction away from the first bracket 3000A (FIG. 1B) and away from outer portion 3010A of the first bracket 3000A (both best seen in FIG. 3) in particular, which force would cause the bottom portion 4400 of the outer cover 4000 to tear along the first and second bottom tear lines 4410, 4420 in a constrained, controlled and rapid fashion. In other examples, each end portion 4500, 4600 may have tabs or flaps that overlap other flaps. Particularly, flaps from the first and second side portions 4100, 4200 may underlie flaps from the top and bottom portions 4300, 4400. In such examples, the overlying flaps from the top and bottom 4300, 4400 portions may serve as gripping portions directly. In both examples, the gripping portions may be grasped to pull the bottom portion 4400 away from the rest of the outer cover 4000.

As the bottom portion 4400 of the outer cover 4000 is thus pulled away from the rest of the outer cover 4000, the first end 3050 of the first bracket 3000A is then exposed, including portions of both the outer and cartridge support portion 3010A, 3020A. Gripping features 3070A formed on the first end 3050A of the bracket to provide or enhance gripping of the bracket. In the illustrated example, the gripping features 3070A are formed on the outer portion 3010A.

By using the gripping features 3070A, the first bracket 3000A may then be pulled away from the rest of the remaining cartridge container assembly 1000. Referring to FIGS. 1A and 4A, a first side tear line 4110 is formed in the first side 4100 of the outer cover 4000 that is generally parallel to the first bottom tear line 4410. In at least one example, the first bottom tear line 4410 and the first side tear line 4110 demarcate or bound ends or boundaries of a first coupling zone between the first lateral sidewall 3030A of the first bracket 3000A and the first side 4110 of the outer cover 4000. In at least one example, first lateral side wall 3030A is secured to the outer cover 4000 between the first bottom tear line 4410 and the first side tear line 4110, such as by adhesive, fasteners, or any other type of selective coupling.

In such a configuration, when the bottom portion 4400 of the outer cover 4400 is removed as described above, the first bracket 3000A (FIG. 3A) remains secured to the outer cover 4000 via the coupling of the first lateral sidewall 3030A of the first bracket to the first side 4100 of the outer cover along the first coupling zone 4120. As the first bracket is pulled away from the rest of the cartridge container, the first side tear line 4110 causes the first side portion 4100 and the first coupling zone 4120 to separate along the first side tear line 4110, thereby completing separation of the first bracket 3000A (and the cartridges coupled thereto) from the remaining outer cover 4000 and the rest of the firearm cartridge container assembly 1000.

Figure 5:
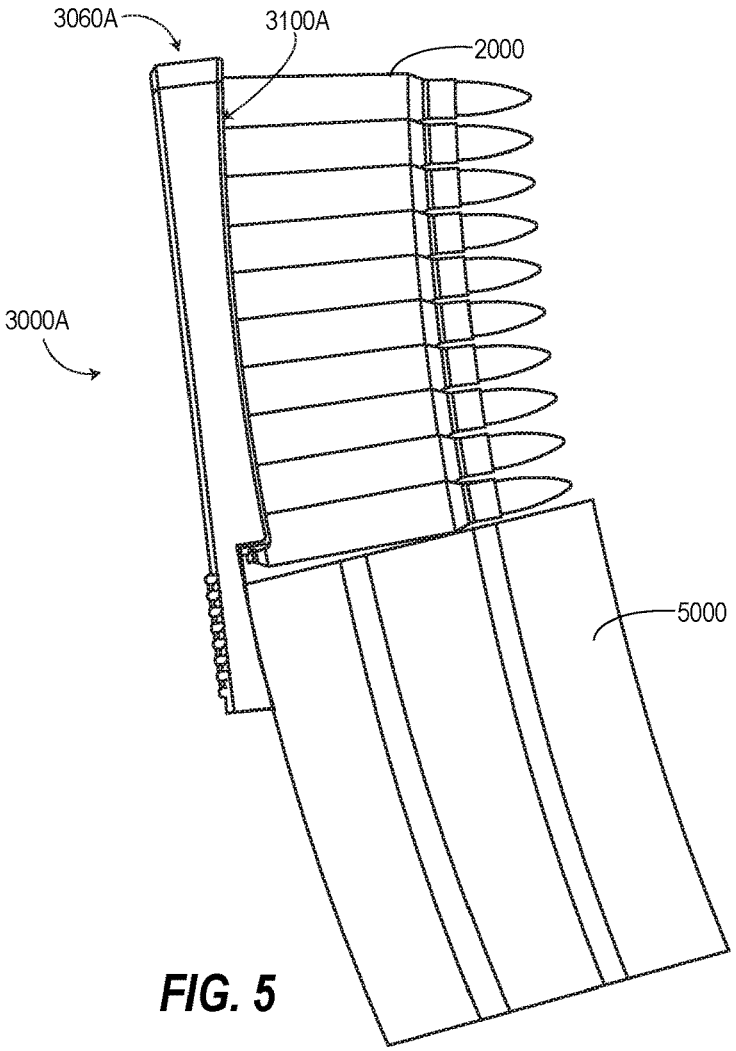
FIG. 5 is a side view of a bracket in position to load cartridges into a magazine.

As shown in FIG. 5, the first bracket 3000A may then be positioned adjacent a magazine 5000 to load the cartridges 2000 from the first bracket 3000A into the magazine 5000. For example, the magazine engagement portion 3200A may be positioned adjacent the rear of a magazine 5000. As the lip 3150 between the rim engaging portion 3100A and the retention portion 3300 (FIG. 3) of the first bracket 3000A is positioned against the magazine 5000, holding the first bracket 3000A in place against the magazine 5000 may act to depress the tab 3410A (FIG. 3) to thereby allow the cartridges 2000 to move past the depressed tab mechanism (FIG. 3) and into the magazine 5000 as an appropriate force is applied to the cartridges 2000. The rim engaging portion 3100A helps maintain the cartridges 2000 in alignment such that a force applied to the cartridge 2000 closest the second end 3060A of the first bracket 3000A is applied through all the cartridges 2000 to feed the cartridges 2000 into the magazine 5000.

As seen in FIG. 1B, when the cartridge container assembly 1000 is assembled, the second bracket 3000B has a determined number of cartridges 2000 in place in substantially similar manner as described above with respect to the first bracket 3000A. In the illustrated example, the first lateral sidewall 3030B of the second bracket 3000B is secured to a portion of the second side 4200 of the outer cover 4000, while the outer portion 3010B is adjacent the top portion 4300 of the outer cover 4000. In at least one example, the top portion 4300 of the outer cover 4300 is wider than the outer portion 3010B of the second bracket 3000B.

As shown in FIGS. 4A and 4B, the top portion 4300 is scored, perforated, or otherwise selectively weakened so as to provide first and second top tear lines 4310, 4320 the first top tear line being approximately along the intersection of the top portion 4300 and second side portion 4200 and the second top tear line 4320 being approximately along the intersection of the top portion 4300 and the first side portion 4100, perforations, or selectively weakened region along which the outer cover 4000 will tear when subjected to a force applied thereto.

As shown in FIGS. 1A, 4A, and 4B, the top portion 4300 of the outer cover 4000 is in communication with a top or second punch tab 4800 of the second end 4600 of the outer cover 4000. The second punch tab 4800 may be selectively weakened, such as by perforations, scoring or other selective weakening methods. Accordingly, the second punch tab 4800 and the top portion 4300 of the outer cover 4000 contain perforations or cutouts that demarcate or otherwise form a selectively removable tear-away portion. In such an example, pushing against the second punch tab 4800 may cause the second punch tab 4800 to tear, which may in turn provide a gripping surface or portion.

When used as a gripping portion, the second punch tab 4800 may then be used to apply a force against the top portion 4300 of the outer cover 4000 in a direction away from the second bracket 4300B (FIG. 1B) and away from the outer portion 3010B of the second bracket 3000B (FIG. 1B) in particular, which force would cause the top portion 4300 of the outer cover 4000 to tear along the top tear lines 4310, 4320 or perforations in a readily controlled and rapid fashion.

As the top portion 4300 of the outer cover 4000 is thus pulled away from the rest of the outer cover 4000, the first end 3050B of the second bracket 3000B is exposed, including portions of both the outer and cartridge support portion 3010A, 3020A. Gripping features 3070A formed on the first end 3050A of the bracket 3000A provide or enhance gripping of the second bracket 3000B. In the illustrated example, the gripping features 3070B are formed on the outer portion 3010B.

The first end 3050B of the second bracket 3000B is then exposed. The first end 3050B may include gripping features 3070B, such as serrations or other features formed thereon to provide or enhance gripping of the second bracket 3000B.

By using the gripping features, the second bracket 3000B may then be pulled away from the rest of the remaining cartridge container assembly 1000. A second side tear line 4210 is formed in the second side 4200 of the outer cover 4000 that is generally parallel to the first top tear line 4310. In at least one example, the first top tear line 4310 and the second side tear line 4210 demarcate the bounds of a second coupling zone 4220 between the first lateral sidewall 3030B of the second bracket 3000B and the second side 4200 of the outer cover. In at least one example, the first side of the second bracket is secured at these locations, such as by adhesive, fasteners, or any other type of selective coupling.

In such a configuration, when the top portion 4300 of the outer cover 4000 is removed as described above, the second bracket 3000B remains secured to the outer cover 4000 via the coupling of the second side 4200 of the second bracket 3000B to the second side 4200 of the outer cover 4000 along the second coupling zone 4220. As the second bracket 3000B is pulled away from the rest of the cartridge container assembly 1000, the second side tear line 4210 causes the second side portion 4200 and the second coupling zone 4220 to separate along the second side tear line 4210, thereby completing separation of the second bracket 3000B (and the cartridges coupled thereto) from the remaining outer cover 4000 and the rest of the cartridge container assembly 1000.

Thereafter, the second bracket 3000A may then be positioned adjacent a magazine (5000, FIG. 5) to load the cartridges from the bracket into the magazine as previously introduced. In at least one example, when assembled, the first and second coupling zones each do not extend into adjacency with the cartridge support portions of the first and second brackets respectively so as to provide clearance between any remaining portion of the outer cover that is torn away with the bracket as the bracket is freed from the remaining outer cover. Accordingly, the first and second coupling zones 4120, 4220 may extend a shorter distance from the outer portions 3010A, 3010B and the case support surfaces 3110A, 3110B than the full depth of the lateral side walls 3030A, 3030B, which distance may cause the first and second coupling zones 4120, 4220 to stop short of the lateral sidewalls 3040A, 3040B.

The outer cover 4000 may be formed in any suitable manner of any suitable material. For example, the outer cover 4000 may be formed of pulp products, such as cardboard or cardstock, of polymers, of metallic materials, and/or combinations of such materials. In examples where pulp products are used, pulp products may be formed in sheets and have the tear lines 4110. 4210, 4310, 4410 or other features designed to facilitate and direct tearing in the manners described above to expose and remove brackets 3000A, 3000B from the remainder of the cartridge container assembly 1000. In such examples, the brackets 3000A, 3000B (and the first sides of the brackets 3000A, 3000B in particular) may be secured to the outer cover 40000 in any suitable manner and at any appropriate point during the process of assembling the cartridge container.

In at least one example, sheets or rolls of outer covers may be formed under a continuous process and adhesive may be applied to the outer cover 4000 while the outer cover 4000 is flat. Thereafter, the brackets 3000A, 3000B may then be pressed against the adhesive to secure the selected portion of the brackets 3000A, 3000B in place relative to the outer cover. In some examples, the brackets 3000A, 3000B may have the cartridges 2000 already positioned therein or coupled thereto while in other examples, the cartridges 2000 may be coupled to the brackets 3000A, 3000B after the brackets 3000A, 3000B have been secured to the outer cover.

In one example, after the brackets 3000A, 3000B have been secured to the outer cover 4000, the outer cover 4000 may be folded to form the shape and configuration described above. The brackets 3000A, 3000B may be formed from any suitable material using any suitable processes. In some examples, the brackets 3000A, 3000B may be formed of a polymer material and formed using a molding process, such as injection molding or other molding processes.

In some examples, the outer cover may be formed of polymer materials. In some examples, the brackets and polymers may be formed of polymer materials and may be initially formed together in a single polymer shaping process, such as a single molding process.

Accordingly, a firearm cartridge assembly has been described herein that includes an outer cover that is coupled with the first and second brackets in such a way that the first and second brackets may be rapidly pulled from the rest of the cartridge container assembly and the cartridges may then be quickly loaded from the then-freed first bracket or second bracket into a magazine or otherwise taken from the first bracket or second bracket as applicable.

The invention claimed is:

1. A container for firearm cartridges, comprising:

a first bracket having a first side portion, a second side portion, an outer portion, and a cartridge support portion;

a second bracket having a first side portion, a second side portion, an outer portion and a cartridge support portion; and an outer cover having a top portion, a bottom portion, a first side portion, a second side portion, a first end, and a second end, the first bracket being coupled to the outer cover and the second bracket being coupled to the outer cover such that the cartridge support portion of the first bracket faces the cartridge support portion of the second bracket, wherein the bottom portion has at least one bottom tear line formed therein to facilitate removal of the bottom portion of the outer container to expose the first bracket, wherein the top portion has at least one top tear line formed therein to facilitate removal of the top portion of the outer cover to expose the second bracket, where the at least one bottom tear line includes a first bottom tear line and a second bottom tear line and the at least one top tear line includes a first top tear line and a second top tear line, wherein the first bracket includes a first lateral sidewall and a second lateral sidewall and the second bracket includes a first lateral sidewall and a second lateral sidewall, wherein the first lateral sidewall of the first bracket is secured to a portion of the first side portion of the outer cover and a first lateral sidewall of the second bracket is secured to a portion of the second side portion of the outer cover, and wherein the first side portion of the outer cover has a first side tear line formed therein and the second side portion of the outer cover has a second tear line formed therein.

2. The container for firearm cartridges of claim 1, wherein the first bottom tear line is formed on the bottom portion of the outer cover adjacent an intersection of the first side portion of the outer cover and the bottom portion of the outer cover, the second bottom tear line is formed on the bottom portion of the outer cover adjacent an intersection of the bottom portion and the second side portion of the outer cover and wherein the first top tear line is formed on the top portion of the outer cover adjacent an intersection of the top portion and the second side portion and the second top tear line is adjacent an intersection of the top portion and the first side portion.

3. The container for firearm cartridges of claim 2, wherein the first lateral sidewall of the first bracket is secured to the outer cover between the first side tear lines and the first bottom tear lines and the first lateral sidewall of the second bracket is secured to the outer cover between the second side tear line and the first top tear line.

4. The container for firearm cartridges of claim 3, and further comprising a first punch tab portion formed on the first end of the outer cover and a second punch tab formed on the second end of the outer cover, the first punch tab being coupled to the bottom portion of the outer cover and the second punch tab being coupled to the top portion of the outer cover.

5. The container for firearm cartridges of claim 4, wherein the first bracket and the second bracket are coupled to the outer cover in such a way that removing the bottom side and the top side does not decouple the first bracket or the second bracket from the outer cover.

6. The container for firearm cartridges of claim 1, and further comprising a first punch tab portion formed on the first end of the outer cover and a second punch tab formed on the second end of the outer cover, the first punch tab being coupled to the bottom portion of the outer cover and the second punch tab being coupled to the top portion of the outer cover.

7. The container for firearm cartridges of claim 1, wherein the first bracket and the second bracket are coupled to the outer cover in such a way that removing the bottom side and the top side does not decouple the first bracket or the second bracket from the outer cover.

8. A firearm cartridge container assembly, comprising:

a first bracket having a first side portion, a second side portion, an outer portion, and a cartridge support portion;

a second bracket having a first side portion, a second side portion, an outer portion, and a cartridge support portion;

an outer cover having a top portion, a bottom portion, a first side portion, a second side portion, a first end, and a second end, the first bracket being coupled to the outer cover and the second bracket being coupled to the outer cover such that the cartridge support portion of the first bracket faces the cartridge support portion of the second bracket, wherein the bottom portion has at least one bottom tear line formed therein to facilitate removal of the bottom portion of the outer container to expose the first bracket, wherein the top portion has at least one top tear line formed therein to facilitate removal of the top portion of the outer container to expose the second bracket, wherein the first bracket and the second bracket are coupled to the outer cover in such a way that removing the bottom side and the top side does not decouple the first bracket or the second bracket from the outer cover; and a plurality of cartridges coupled to the first bracket and a plurality of cartridges coupled to the second bracket, wherein the plurality of cartridges coupled to the first bracket extend away from the first bracket toward the second bracket and the plurality of cartridges coupled to the second bracket extend away from the extend bracket toward the first bracket, where the at least one bottom tear line includes a first bottom tear line and a second bottom tear line and the at least one top tear line includes a first top tear line and a second top tear line, wherein the first bracket includes a first lateral sidewall and a second lateral sidewall and the second bracket includes a first lateral sidewall and a second lateral sidewall, wherein the first lateral sidewall of the first bracket is secured to a portion of the first side portion of the outer cover and a first lateral sidewall of the second bracket is secured to a portion of the second side portion of the outer cover, and wherein the first side portion of the outer cover has a first side tear line formed therein and the second side portion of the outer cover has a second tear line formed therein.

9. The container for firearm cartridges of claim 8, wherein the first bottom tear line is formed on the bottom portion of the outer cover adjacent an intersection of the first side portion of the outer cover and the bottom portion of the outer cover, the second bottom tear line is formed on the bottom portion of the outer cover adjacent an intersection of the bottom portion and the second side portion of the outer cover and wherein the first top tear line is formed on the top portion of the outer cover adjacent an intersection of the top portion and the second side portion and the second top tear line is adjacent an intersection of the top portion and the first side portion.

10. The container for firearm cartridges of claim 9, wherein the first lateral sidewall of the first bracket is secured to the outer cover between the first side tear lines and the first bottom tear lines and the first lateral sidewall of the second bracket is secured to the outer cover between the second side tear line and the first top tear line.

11. The container for firearm cartridges of claim 10, and further comprising a first punch tab portion formed on the first end of the outer cover and a second punch tab formed on the second end of the outer cover, the first punch tab being coupled to the bottom portion of the outer cover and the second punch tab being coupled to the top portion of the outer cover.

12. The container for firearm cartridges of claim 11, wherein the first bracket and the second bracket are coupled to the outer cover in such a way that removing the bottom side and the top side does not decouple the first bracket or the second bracket from the outer cover.

13. The container for firearm cartridges of claim 8, and further comprising a first punch tab portion formed on the first end of the outer cover and a second punch tab formed on the second end of the outer cover, the first punch tab being coupled to the bottom portion of the outer cover and the second punch tab being coupled to the top portion of the outer cover.

14. The container for firearm cartridges of claim 8, wherein the first bracket and the second bracket are coupled to the outer cover in such a way that removing the bottom side and the top side does not decouple the first bracket or the second bracket from the outer cover.

* * * * *